United States Patent [19]

Weiger et al.

[11] Patent Number: 4,584,980

[45] Date of Patent: Apr. 29, 1986

[54] ELECTRICALLY OPERATED VALVE

[75] Inventors: Günter Weiger, Esslingen; Dieter Dörrie, Plochingen; Paul Schwerdt, Freudenstadt, all of Fed. Rep. of Germany

[73] Assignee: Daimler-Benz Aktiengesellschaft, Fed. Rep. of Germany

[21] Appl. No.: 525,629

[22] Filed: Aug. 23, 1983

[30] Foreign Application Priority Data

Oct. 8, 1982 [DE] Fed. Rep. of Germany ..... 3237258

[51] Int. Cl.[4] ..... F02M 51/06

[52] U.S. Cl. ..... 123/458; 251/30.01; 251/129.06; 251/129.02; 123/498; 310/346

[58] Field of Search ..... 251/14, 129, 11, 77, 251/81, 50, 30.01; 123/498, 497, 458, 506; 239/102, 124, 397.5; 310/328, 338, 346

[56] References Cited

U.S. PATENT DOCUMENTS

| | | | |
|---|---|---|---|
| 2,537,450 | 1/1951 | Ewing | 251/129 X |
| 2,698,157 | 12/1954 | Ludemann | 251/14 |
| 3,194,162 | 7/1965 | Williams | 239/102 X |
| 4,022,166 | 5/1977 | Bart | 251/129 |
| 4,284,263 | 8/1981 | Newcomb | 251/129 |
| 4,440,134 | 4/1984 | Nalzao et al. | 123/458 X |
| 4,460,846 | 6/1984 | Weiger et al. | 310/328 |
| 4,475,515 | 10/1984 | Mowbray | 123/458 X |

FOREIGN PATENT DOCUMENTS

| | | | |
|---|---|---|---|
| 2402085 | 8/1974 | Fed. Rep. of Germany | 251/129 |
| 2443561 | 7/1975 | Fed. Rep. of Germany | 251/150 |
| 3039972 | 5/1982 | Fed. Rep. of Germany | 123/498 |
| 2082251 | 3/1982 | United Kingdom | 123/498 |

*Primary Examiner*—Samuel Scott
*Assistant Examiner*—Carl D. Price
*Attorney, Agent, or Firm*—Craig and Burns

[57] ABSTRACT

Electrically operated valve for liquid or gaseous media, suitable for internal combustion engines, possessing an electrically-activated actuating element with a short actuating displacement, this actuating element acting on a control valve, and possessing a nozzle element which unblocks a nozzle when a defined pressure is present in the supply line. The actuating element is connected to an actuating-element base and is pressed, by means of an actuating-element spring, against the control-valve plate of the control valve, this control-valve plate being pressed, by a stronger control-valve spring, against a fixed reference plane. In order to compensate for changes in the length of the actuating element, resulting from mechanical forces and/or from temperature changes, a collect-type clamping device is provided, which is subjected to the pressure of the medium and clamps the actuating element while it is being operated.

6 Claims, 1 Drawing Figure

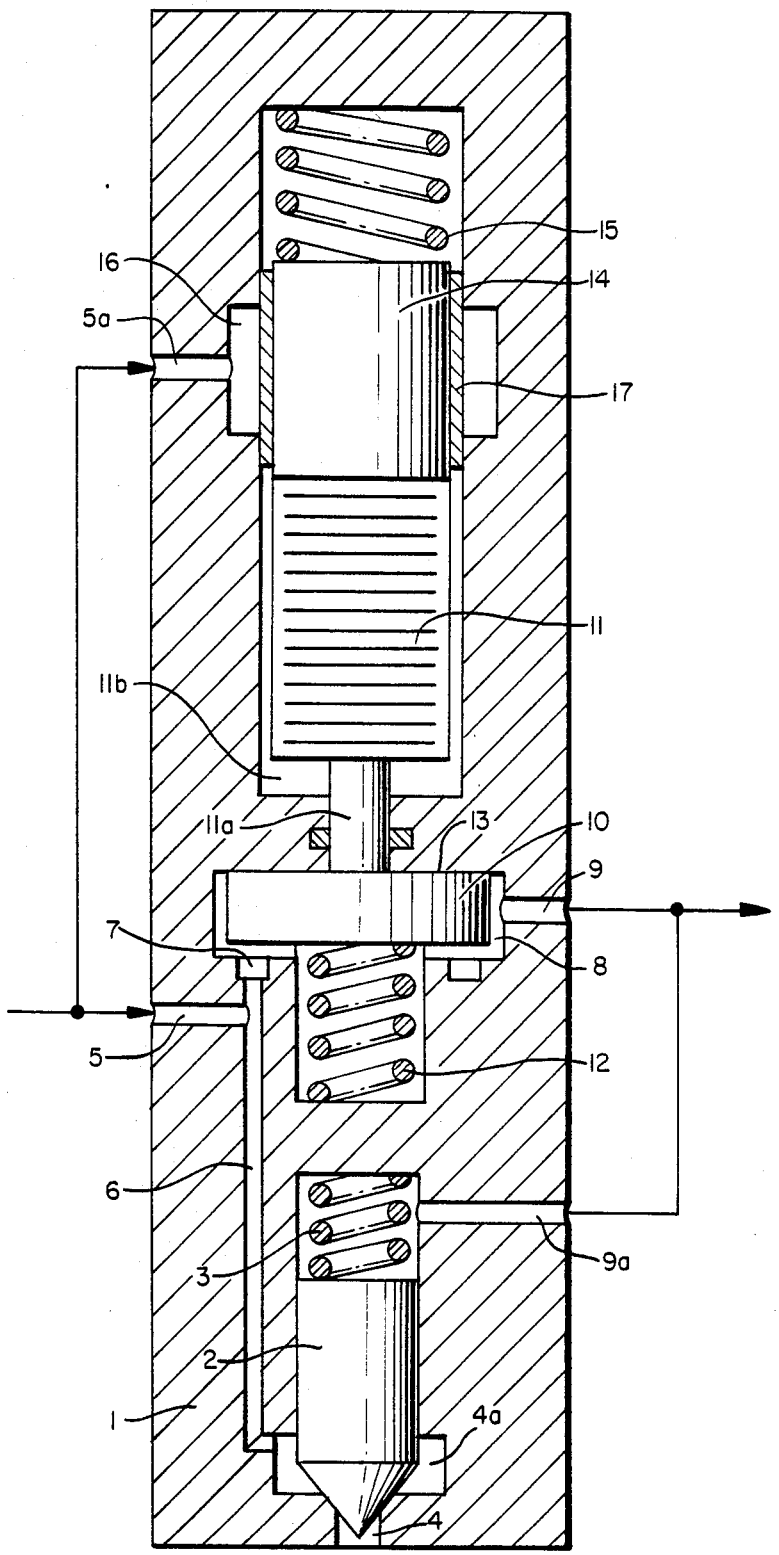
15
16
14
5a
17
11
11b
11a
13
10
9
7
8
5
12
6
9a
3
2
1
4a
4

ELECTRICALLY OPERATED VALVE

The invention relates to an electrically operated valve for liquid or gaseous media, for fuel-injection system for internal combustion engines, this valve possessing an electrically-activated actuating element with a short actuating displacement, this actuating element acting on a control valve which, in the rest position, connects the medium-supply line to a return line, but which, in the operating position, closes this connection, and possessing a nozzle element which unblocks a nozzle when a defined pressure is present in the supply line.

Actuating elements with short actuating displacements are, for example, magnetostrictive or piezoceramic devices. Characteristic properties of piezoelectric actuating elements are short switching times, of the order of 50 $\mu$s, in association with actuating displacements of approximately 0.05 mm and actuating forces of up to 1 kN or above.

Known piezoelectric actuating elements have overall lengths ranging between 50 and 100 mm. If their mean linear thermal expansion coefficients, $\alpha$, are considered as being $20.10^{-6}/°C.$, this means that a temperature-change of 100° C. will be accompanied by a length-change of 0.01 mm, as $\Delta\iota=\iota o\cdot\alpha\cdot\Delta T$. Referred to an actuating displacement of 0.05 mm, this length-change thus results in a loss of 20%.

If actuating elements, of this type, are employed in high-pressure hydraulic systems operating, for example, at pressures in the region of 1000 bar, mechanical deformations, caused by hydraulic effects, are also added, and these further reduce the usable actuating displacement.

An actuating element is known from German Pat. No. 3,037,078, which achieves compensation of the thermally induced length-changes by arranging for the piezo-element and the spacing element to be composed of the same material.

This solution requires a major effect in terms of manufacturing technology, and is very expensive. Moreover, it is unlikely that this solution could be applied in the case of high-pressure systems, due to the fact that the materials are brittle.

A solution is known, from German Offenlegungsschrift 2,931,874, in which the actuating element operates via a spring/mass system, with a damping device, and effects temperature-compensation by this means. However, this actuating element is suitable only for short, dynamic operations, but it cannot maintain a defined actuating-element position in a static manner.

The invention provides an electrically operated valve for actuating elements, with a short actuating displacement, and at low cost, which valve automatically compensates for changes in the actuating displacement, resulting from temperature-related and mechanical effects, even when employed in high-pressure systems, and which is suitable both for comparatively long activation-times and for short, dynamic activation-times.

This is achieved, according to the invention, by means of a control-valve plate, which can move, axially, in a control-valve chamber, is pressed against a reference surface facing an actuating element, by means of a control-valve spring, the actuating elment being connected, at its end facing away from the control valve, to an actuating-element base, an actuating-element spring, located between the actuating-element base and the valve housing, presses the actuating element against the control-valve plate, the force of the control-valve spring exceeding that of the actuating-element spring. The valve housing possesses an annular passage in the region of the actuating-element base, the annular passage being normal to the axis, and machined out of the actuating-element chamber, being connected to the supply line, and being closed by means of a clamping sleeve which is connected, material to material, to the valve housing, the actuating element being guided in this clamping sleeve by means of the actuating-element base, in a manner permitting axial displacement.

This solution has the advantage that account is taken of each change in the length of the actuating element up to immediately before its operation and, as a result, its full actuating displacement is available during each operation, irrespective of thermally-induced and/or mechanical deformations. By this means, it is also possible to operate the actuating element statically, that is to say to leave the valve open for a comparatively long time, provided, at least, no deformations of the actuating element are to be expected during the intervening period.

It is an object therefore of the invention to provide an improved electrically operated valve for a liquid or gas medium for fuel-injection systems for internal combustion engines.

It is another object of the invention to provide an electrically operated valve for fuel injection systems wherein the position of an actuating means for the valve is compensated for thermal and/or mechanical deformation of the length change in the actuating means.

It is another object of the invention to provide an improved electrically operated valve means for fuel injection systems of internal combustion engines which is inexpensive to produce, relative to those of the prior art.

It is a further object of the invention to provide an improved electrically operated valve for fuel injection systems of internal combustion engines which solves problems inherent in the prior art structures.

It is a further object of the invention to provide an improved electrically operated valve for fuel injection systems of internal combustion engines wherein an actuating means for the valve is clamped during application of fuel pressure to the valve, the clamping being maintained throughout the fuel delivery to the valve, thereafter, the positioning of the actuating means being adjusted to compensate for thermal and deformation induced length changes in the actuating means.

It is another object of the invention to produce an electrically operated valve for one of liquid and gaseous media, for fuel-injection systems for internal combustion engines, the valve possessing a valve housing and an electrically-activated actuating element with a short actuating displacement, the actuating element acting on a control valve along an axis and which, in the rest position, connects a supply line for a medium to a return line, but which, in the operating position, closes said connection, and possessing a nozzle element which unblocks a nozzle when a defined pressure is present in the supply line comprising a control-valve plate movable axially, in a control-valve chamber, is pressed against a reference surface facing the actuating element, by means of a control-valve spring, the actuating element connects, at its end facing away from the control valve, to an actuating element base, an actuating-element spring, located between the actuating-element base and the valve housing, presses the actuating element against the control-valve plate, the force of the control-valve spring exceeding that of the actuating-element spring, and an annular passage within the valve housing in the region of the actuating-element base, the annular passage being in a plane normal to the axis, being machined out of the actuating-element chamber, being connected to the supply line and clamping means connected to the valve housing for clamping the annular sleeve with respect to the valve housing under a first condition, the actuating element being guided within the clamping sleeve by means of an actuating-element base, in a manner permitting axial displacement under a second condition.

These and other objects, features and advantages of the present invention will become more apparent from the following description when taken in connection with the accompanying drawings which show, for the purposes of illustration only, one embodiment in accordance with the present invention, and wherein the drawing shows, in cross-section, a fuel-injection valve for internal combustion engines.

A valve needle 2 is located in the lower portion of a common valve housing 1, this valve needle being pressed against the nozzle opening 4 by means of a nozzle-pressure spring 3. A fuel supply line 5 is connected, via a pressure passage 6, to a pressure chamber 4*a*, in which the nozzle opening 4 is located.

The fuel supply line 5 also leads to an annular passage 7 in a control-valve chamber 8, the latter being connected to the fuel return line 9, which is also connected, via the return line 9*a*, to the space in which the nozzle-pressure spring 3 is located.

A control-valve plate 10 is located in the control-valve chamber 8, this plate being moved, by a piezoelectric actuating element 11, when the latter is excited by means of an electrical actuating signal, towards the annular passage 7 and, in its limiting position, closing this passage. This movement is effected against the force of a control-valve spring 12 which, when the actuating element is not excited, presses the control-valve plate 10 against the bounding surface of the control-valve chamber 8 which, facing the actuating element 11, serves as a reference surface 13.

The actuating element 11 is composed of a piezoceramic material, and is rigidly connected, at its end facing away from the control valve, to a metallic actuating-element base 14. An actuating-element spring 15, which bears against the valve housing 1, presses the actuating element 11, via its base 14 and a plunger 11*a* against the control valve spring 12, the latter being, according to the invention, greater than that of the actuating-element spring 15, by a factor of approximately 10 in this illustrative embodiment, as a result of which the reference surface 13 represents the starting position for every movement of the actuating element 11, at all temperatures and pressures.

In the region of the actuating-element base 14, the actuating-element chamber 11*b* possesses an annular passage 16, which is connected, via the passage 5*a*, to the fuel supply line 5, and which is closed by means of a clamping sleeve 17 which is connected, material to material, to the valve housing 1. The actuating element 11 is guided in this clamping sleeve 17, by means of the actuating-element base 14, in a manner permitting axial displacement.

The mode of operation of the fuel-injection valve is described in the paragraphs which follow. A fuel pump, which is not represented, supplies the fuel, at maximum pressures in the region of 1000 bar, to the fuel-injection valve, in an intermittent manner, mechanically synchronized by a rotating component of the internal combustion engine which is to be controlled. In the rest position, the fuel supply line 5 is connected to the fuel return line 9, via the annular passage 7 and the clearance in the control-valve chamber 8, the latter having a maximum width of approximately 0.05 mm. This narrow clearance forms a flow-restriction point.

If, now, fuel is supplied, from the fuel pump, a pressure of a few bar—for instance 10 to 30 bar—builds up, upstream of the flow-restriction point, and propagates, via the pressure passage 6, into the pressure chamber 4*a* and, via the passage 5*a* into the annular chamber 16. This comparatively low super-atmospheric pressure prevents the valve needle 2 from unblocking the nozzle opening 4, since the nozzle-pressure spring 3 is set to a value of approximately 100 bar, but it is sufficient to clamp the actuating element 11, to an adequate extent, by means of the collector clamping sleeve 17, which acts on the actuating-element base 14. At the suitable moment, an electrical "injection pulse" occurs at the actuating element 11, this pulse being synchronized by means of an electronic injection-control system (not shown), and causing the actuating element to expand and to press the control-valve plate 10 downwards, against the force of the control-valve spring 12, as a result of which the annular passage 7 is closed and the full pressure can build up against the valve needle 2 and, moreover, against the collector clamping sleeve 17, thereby further clamping the actuating element. When the pressure which is defined by the nozzle-pressure spring 3 is reached, the valve needle 2 unblocks the nozzle opening 4 and fuel is injected at high pressure.

Following the end of the "injection pulse", the control-valve plate 10 is pressed back, against the reference surface 13, the high pressure collapses, and the valve needle 2 closes the nozzle opening again. The injection process is completed. The slight super-atmospheric pressure, created by the flow-restriction point, remains, and the actuating element 11 hence remains clamped, but only until the fuel pump ceases its delivery. The actuating element 11, which has then been released, can execute, during this period between two delivery cycles, its thermally-induced or deformation-induced length-change, against only the force of the actuating-element spring 15, before it is securely clamped again in the course of the next delivery cycle, since, on the other side, the stronger control-valve spring 12 causes it to bear against the reference surface 13, via the plunger 11*a*.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

What is claimed is:

1. An electrically operated valve assembly for one of liquid and gaseous media, said valve having a supply line fluidly connected to a nozzle in a fluid flow connection and a return line, for fuel-injection systems for internal combustion engines comprising;

a valve housing containing an actuating element chamber, an electrically-activated actuating element having an axis, said actuating element lying within the actuating element chamber, said electrically-activated actuating element having a base and said electrically-activated actuating element having a short actuating displacement along said axis, a control valve means responsive to said actuating element for coupling said supply line to permit flow of said medium to said return in a rest position and for uncoupling said supply line from said return line in an operating position to block flow of said medium to said return line, the control valve means comprising a control-valve chamber in communication with the supply line and return line, said control valve chamber having a first surface remote from the actuating element along the axis and a reference surface proximate to the actuating element along the axis, a control-valve plate movable between the rest and uncoupling positions axially in said control valve chamber, said control-valve plate being pressed against said reference surface in the rest position in response to a control-valve spring means disposed between the valve housing and a surface of said control-valve plate, a nozzle in fluid communication with said supply line, a nozzle control means for unblocking the nozzle when a defined pressure is present in the supply line, an actuating-element spring, located between the actuating-element base and the valve housing, pressing the actuating element against the control-valve plate, the force of the control-valve spring exceeding that of the actuating-element spring, an annular passage within the valve housing proximate the actuating-element base, the annular passage being in a plane normal to the axis and machined out of the actuating-element chamber, and connected to the supply line, and clamping means positioned adjacent said annular passage and connected to the valve housing for clamping the actuating element base with respect to the valve housing in response to a first condition of increase in pressure in the supply line and for releasing the actuating element base with respect to the valve housing to permit axial displacement of the actuating element under a second condition defined by the cessation of delivery of fuel by said supply line.

2. A valve assembly operated by an electrical signal for injection systems for internal combustion engines, said valve assembly comprised of a valve housing, a valve seat and an exhaust port wherein both the valve seat and exhaust port are located within said housing, fuel supply and an actuating means, the actuating means being responsive to said electrical signal and subject to at least one of thermal length changes and deformation induced length changes, the actuating means including an actuating means base displaceable along a valve axis, means for clamping the actuating means base with respect to the valve housing, said means for clamping being responsive to fuel delivery to the valve assembly a control valve plate means, said actuating means engageable with said control valve plate means to cause the control valve plate means to engage said valve seat, means for forcing the control valve plate means away from the valve seat of the valve housing prior to application of fuel pressure to said valve assembly to allow fluid connection between the fuel supply and exhaust port, and wherein said means for forcing further repositions said control valve plate means away from the valve seat of the housing means following the cessation of clamping to compensate for said one of thermal length change and deformation induced length change in said actuating means.

3. An electrically operated valve assembly in accordance with claim 2, wherein said valve housing has an actuating means chamber containing the actuating means and said means for clamping comprises a sleeve means in contact with the valve housing within the actuating means chamber for clamping the actuating means base with respect to the valve housing.

4. An electrically operated valve assembly in accordance with claim 2, wherein said means for clamping comprises collar means fixed with respect to the valve housing for clamping the actuating means base with respect to the valve housing.

5. An electrically operated valve assembly for one of liquid and gaseous media, said assembly having a fuel supply and fuel supply line fluidly connected to a nozzle in a fluid flow connection and a return line, for fuel-injection systems for internal combustion engines, said assembly further comprising a valve housing containing an actuating element chamber, an electrically-activated actuating element having an axis, said actuating element lying within the actuating element chamber subject to at least one of thermal length changes and deformation induces length changes, said electrically actuating element having an actuating element base and said electrically-activated actuating element having a short actuating displacement along said axis, a control valve means responsive to said actuating element for coupling said supply line to permit flow of said medium to said return line in a rest position and for uncoupling said supply line from said return line in an operating position to block flow of said medium to said return line, said control valve means comprising a control-valve chamber in communication with the supply line and return line having a first surface remote from the actuating element along the axis and a reference surface proximate to the actuating element along the axis, a control-valve plate movable axially between the rest and uncoupling positions in said control valve chamber, said control-valve plate plate being pressed against said reference surface in the rest position in response to a control-valve spring means disposed between the valve housing and a surface of said control-valve plate, said nozzle in fluid communication with said supply line, a nozzle control means for unblocking the nozzle when a defined pressure is present in the supply line, an actuating-element spring, located between the actuating-element base and the valve housing, pressing the actuating element against the control-valve plate, the force of the control-valve spring exceeding that of the actuating-element spring, an annular passage within the valve housing proximate the actuating-element base, the annular passage being in a plane normal to the axis and machined out of the actuating-element chamber, and connected to the supply line, clamping means connected to the valve housing for clamping the actuating element base with respect to the valve housing in response to a first condition of increase in pressure in the supply line and fuel delivery to the valve assembly and for releasing the actuating element base with respect to the valve housing in response to a second condition to permit axial displacement of the actuating element under said second condition defined by cessation of delivery of fuel by said supply line, means for forcing the control valve plate against the valve housing prior to application of fuel pressure to said valve, and for repositioning the actuating element following the cessation of clamping to compensate for said one of thermal length change and deformation induced length changes in said actuating element, wherein said valve housing has an actuating element chamber containing the actuating element and said means for clamping comprises a sleeve means in contact with the valve housing within the actuating element chamber for clamping the actuating element with respect to the valve housing and further comprising a chamber defined by the annular passage and contiguous to said clamping means for receiving fuel under pressure.

6. An electrically operated valve assembly in accordance with claim 2 further comprising a control valve chamber within the valve housing, a passage within the vale housing for receiving fuel under pressure, said control valve plate means being movable axially in said control valve chamber in response to said actuating means for closing said passage in response to said fuel pressure and repositioned in response to said means for repositioning.

* * * * *